United States Patent [19]

Gruttemeyer et al.

[11] Patent Number: 4,938,505

[45] Date of Patent: Jul. 3, 1990

[54] BUSINESS FORM FOR USE IN SHIPPING PARCELS

[75] Inventors: Frederick E. Gruttemeyer, West Carrollton; James B. Coffey, Dayton, both of Ohio; Peter G. Fransee, Viroqua, Wis.

[73] Assignee: NCR Corporation, Dayton, Ohio

[21] Appl. No.: 392,760

[22] Filed: Aug. 11, 1989

[51] Int. Cl.[5] ..... B41L 1/20

[52] U.S. Cl. ..... 282/12 R; 282/11.5 A; 282/11.5 R; 282/12 A

[58] Field of Search ..... 282/12 R, 11.5 A, 11.5 R, 282/12 A; 229/69, 71; 283/79, 81; 281/2

[56] References Cited

U.S. PATENT DOCUMENTS

| | | | |
|---|---|---|---|
| 31,752 | 12/1984 | Halse | 282/12 R |
| 2,907,585 | 10/1959 | Sornberger et al. | 282/12 A |
| 3,981,435 | 9/1976 | Johnsen | 282/11.5 A |
| 4,178,018 | 12/1979 | Halse | 282/12 A |
| 4,211,434 | 7/1980 | Reese | 282/11.5 A |
| 4,343,492 | 10/1982 | Fitzgibbons | 282/11.5 R |
| 4,346,916 | 10/1982 | Shelton | 282/11.5 A |
| 4,535,930 | 8/1985 | Ward . | |
| 4,570,416 | 2/1986 | Shoenfeld . | |
| 4,583,765 | 4/1986 | Messinger | 283/79 |
| 4,598,935 | 7/1986 | Stewart . | |
| 4,614,361 | 9/1986 | Foster | 283/79 |
| 4,627,994 | 12/1986 | Welsch . | |
| 4,645,123 | 2/1987 | Ashby . | |
| 4,682,793 | 7/1987 | Walz | 282/11.5 A |
| 4,747,618 | 5/1988 | Instance | 283/81 |
| 4,747,619 | 5/1988 | Sager . | |
| 4,772,049 | 9/1988 | Engle | 282/11.5 A |

OTHER PUBLICATIONS

Federal Express Form Exhibit A Date 1/88.
Federal Express Form Exhibit B Date 7/88.
Federal Express Form Exhibit C Date 7/88
Federal Express Form Exhibit D Date 10/88.

*Primary Examiner*—Paul A. Bell
*Assistant Examiner*—Tom Hamill, Jr.
*Attorney, Agent, or Firm*—Wilbert Hawk, Jr.; Albert L. Sessler, Jr.; George J. Muckenthaler

[57] ABSTRACT

A business form of multiple ply construction includes one ply having adhesive thereon for attaching directly to a package being shipped. The one ply is a removable waybill copy portion of the business form which provides a recond of information or data concerning the shipping of the package in an arrangement which does not require a separate pouch on the package.

16 Claims, 8 Drawing Sheets

BUSINESS FORM FOR USE IN SHIPPING PARCELS

BACKGROUND OF THE INVENTION

In the area of fast delivery services, the overnight letter, the express mailer, and next day delivery packages have become common means to transport information and/or material between two businesses or other entities. Several well-known companies in the fast delivery business include Federal Express, Emery and Purolator, Airborne, DHL, and UPS. Each of the letters or packages being shipped must carry identification or information relative to the sender of the package, the transporter of the package, and the recipient of the package. A common business form used in the transport of packages is the airbill which is inserted into a pouch formed of at least one sheet of transparent material on one side of the package so as to allow viewing of the airbill or like document. The airbill may also include a machine readable bar code for record keeping and a human readable number in Arabic and/or OCR numerals to enable the package to be tracked.

Representative documentation in the field of business forms used in fast delivery services includes U.S. Pat. No. 3,981,435, issued to E. L. Johnsen on Sept. 21, 1976, which discloses a continuous business form adapted for subsequent processing into combination mailing envelopes and return envelopes having a common back ply panel.

U.S. Pat. No. 4,211,434, issued to J. Reese on July 8, 1980, discloses a combination container and control form for shipping, identifying and reordering merchandise.

U.S. Pat. No. 4,343,492, issued to G. W. Fitzgibbons on Aug. 10, 1982 discloses a multiple ply adhesive business form.

U.S. Pat. No. 4,346,916, issued to O. A. Shelton on Aug. 31, 1982, discloses a multiple ply business form and manifold assembly.

U.S. Pat. No. 4,535,930, issued to J. O. Ward on Aug. 20, 1985, discloses an overnight letter envelope having a pouch for an airbill.

U.S. Pat. No. 4,570,416, issued to D. B. Shoenfeld on Feb. 18, 1986, discloses an overnight package having a pouch for a letter or an envelope.

U.S. Pat. No. 4,598,935, issued to G. E. Stewart on July 8, 1986, discloses a business form with packing label wherein one of the pages of the form is adapted to be used to form a mailing pouch on a shipping container.

U.S. Pat. No. 4,614,361, issued to R. S. Foster on Sept. 30, 1986, discloses a multiple part shipping label wherein the lower layer has adhesive on its surface for attachment to a shipping document.

U.S. Pat. No. 4,645,123, issued to R. E. Ashby on Feb. 24, 1987, discloses a continuous, filled envelope assembly with non-marginal spaced feed holes.

U.S. Pat. No. 4,627,994, issued to B. J. Welsch on Dec. 9, 1986, discloses a label bearing continuous business form having a ply coated with adhesive and a release liner over the adhesive.

U.S. Pat. No. 4,747,619, issued to F. D. Sager on May 31, 1988, discloses a pressure-sensitive label.

SUMMARY OF THE INVENTION

The present invention relates to multiple ply business forms for use by shipping entities in fast delivery services. More particularly, the present invention relates to a business form which is constructed to include shipping information and which is attached directly to the package being shipped.

In accordance with the present invention there is provided a business form having a first or top ply for receiving record information relative to the sender and receiver of a package, a second or intermediate ply which receives the record information and which serves to transfer such information to another ply, and a third or bottom ply which receives the record information from the second ply, the third ply being coated with adhesive for attaching the third ply to the package.

The business form includes margin strips with pin holes for sprocket pin feeding a web of forms in continuous manner for the imprinting of variable customer information on the forms. The business form also includes carbon leaves or sheets between the plies for transfer of the record information, and lines of adhesive for securing the edges of the plies of each unit set of the business form to provide a secured shipping label.

In accordance with the above discussion, a principal object of the present invention is to provide an improved business form for use in shipping packages.

Another object of the present invention is to provide a business form which is attached to a shipping package in a manner to simplify handling of such package.

An additional object of the present invention is to provide a business form having record information relative to the shipping of the package and wherein a record copy of the form is applied directly to the package.

A further object of the present invention is to provide a business form having a plurality of plies for use in shipping a package and wherein the construction of such form avoids the use of a pouch on the package.

Additional advantages and features of the present invention will become apparent and fully understood from a reading of the following description taken together with the annexed drawing.

DESCRIPTION OF THE PREFERRED EMBODIMENT

Prior to describing the invention in detail, it is noted that in fast delivery operations, a record copy of the information or data concerning the delivery is retained by the sender of the package or other article, a record copy of such information or data is retained as an accounting copy by the transporter or deliverer of the package, and a record shipping copy in the form of a label is securely attached to the package.

The business form of the present invention is used in the manner of a waybill in the delivery of the package and is constructed so as to avoid the need for a separate pouch on the package.

Figure 1:
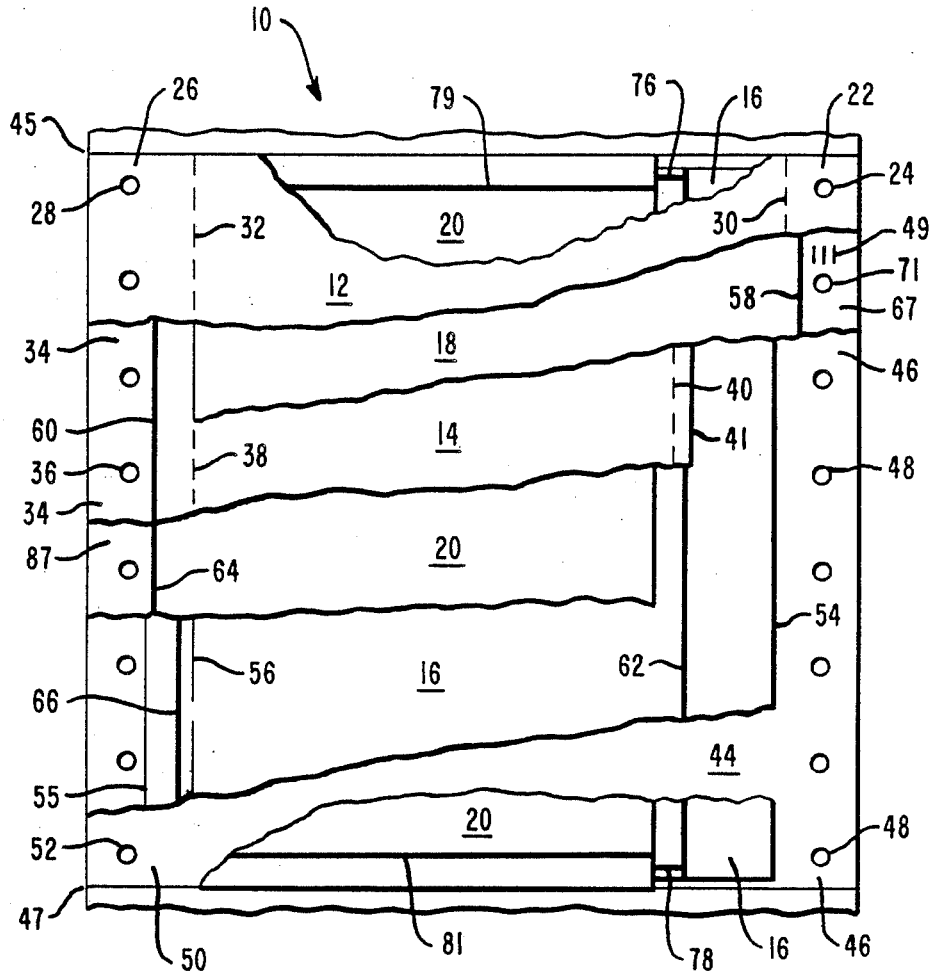
FIG. 1 is a top or front plan view of a preferred arrangement for a business form incorporating the subject matter of the present invention.
Figure 2:
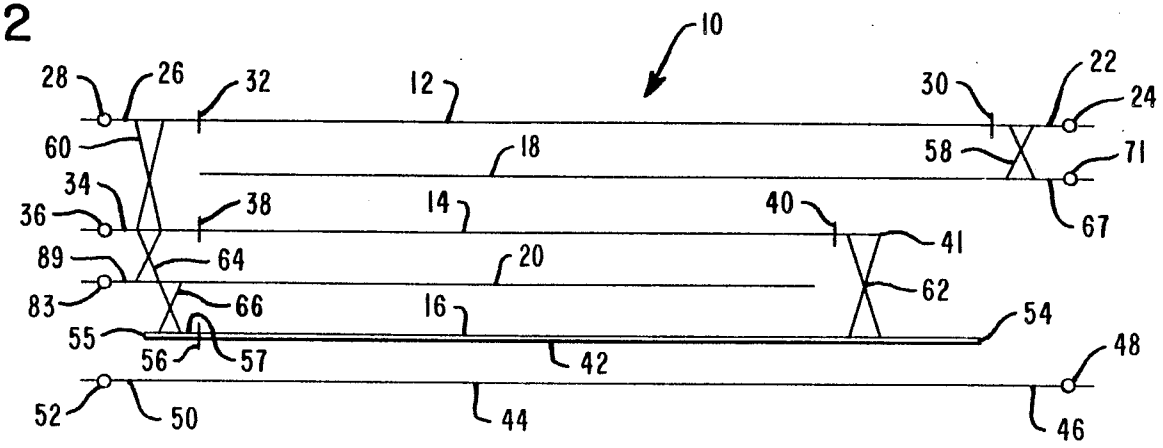
FIG. 2 is an end view of the business form with the several plies being separated in exaggerated manner to show the construction.

Referring now to FIGS. 1 and 2 of the drawing, there is shown a top or front view of a business form 10 of the continuous form type, and an end view of the business form which incorporates the subject matter of and which shows the structure of the present invention. A preferred arrangement or construction of the business form 10 includes a first or top ply or sheet 12 that is made of 15 pound bond paper, a second or intermediate ply or sheet 14 that is made of 20 pound bond paper, and a third or bottom laminate ply 16 that is made of 20 pound pressure sensitive adhesive face stock paper and 50 pound release liner. Of course, other weights suitable for the business form may be used.

A carbon sheet 18 is provided between the first ply or sheet 12 and the second ply or sheet 14 and a carbon sheet 20 is provided between the second ply or sheet 14 and the third ply or sheet 16 to transfer record information or data from the top sheet 12 to the intermediate sheet 14 and to the bottom sheet 16. An alternative construction of the business form, shown in FIGS. 8 and 9, uses chemical carbonless paper in an arrangement wherein the first or top ply is coated back (CB) paper, the second or intermediate ply is coated front and back (CFB) paper, and the third pressure-sensitive or bottom ply is coated front (CF) paper. Additional plies of paper (either carbon interleaved or carbonless) may be inserted between the top ply and the intermediate ply if more documents are required.

A margin strip 22 with pin feed holes 24 is provided at the right side of the form 10 in the top ply 12 and a margin strip 26 with pin feed holes 28 is provided at the left side of the form 10 in the top ply 12. The margin strip 22 is connected to the top ply 12 by a perforated line 30 and the margin strip 26 is connected to the top ply 12 by a perforated line 32.

A margin strip 34 with pin feed holes 36 is provided at the left side of the form 10 in the middle ply 14 and the strip 34 is connected to the middle ply 14 by a perforated line 38. The right side of the middle ply 14 does not have a margin strip but does include a perforated line 40 spaced from the right edge 41 of the middle ply 14.

The bottom ply 16 is described as a label ply by reason of having a coating 42 of adhesive thereon. A release liner ply 44 covers the adhesive coating 42. A portion 46 with pin feed holes 48 is provided at the right side of the release liner ply 44 and a portion 50 at the left side of the ply 44 includes pin feed holes 52. A right hand edge 54 of the bottom ply 16 is spaced inward of the pin feed holes 48 of the release liner ply 44 and a left hand edge 55 of the ply 16 is spaced inward of the pin feed holes 52 of the ply 44. A weak perf line 56 is provided in the bottom ply 16 at the left side thereof. The die cut ties or weak perf line 56 allow the left margin strip of the form to be peeled back to release the middle ply 14 and carbon sheet 20. The left hand margin strip allows easy removal of the middle ply 14 and carbon sheet 20 after the label ply 16 is attached to the package. Since the margin strip is not fastened to the package, the strip provides a grip area for removal of the ply 14 and carbon sheet 20.

A line of adhesive 58 within the margin strip 22 and between the pin feed holes 24 and the perf line 30 secures the carbon sheet 18 to the top ply 12 at the right side thereof. A line of adhesive 60 within the margin strip 26 and within the margin strip 34 secures the top ply 12 and the middle ply 14 at the left sides of such plies 12 and 14.

A line of adhesive 62 is provided at the right side of the middle ply 14 outside the perf line 40 and secures the middle ply 14 to the label ply 16 at the right sides thereof. A line of adhesive 64 is provided within the margin strip 34 and secures the face side of the carbon sheet 20 to the back of the middle ply 14 at the left sides thereof. A line of adhesive 66 is provided at the left side of the bottom ply 16 outside the perf line 56 and secures the back of the carbon sheet 20 and the face side of the label or bottom ply 16 at the left sides thereof. The glue line 66 is nonaligned with glue lines 60 and 64. The weak perf line 56 provides a strip portion 57 at the left edge of the bottom ply 16 which remains with the middle ply 14 and carbon sheet 20 after removal of the release liner ply 44 from the ply 16.

FIG. 1 shows one unit set of the business form 10 which includes the top ply 12, the carbon sheet 18, the middle ply 14, the carbon sheet 20, the bottom ply 16 with the adhesive coating 42 on the bottom surface thereof, and the release liner ply 44. Fold lines 45 and 47 designate the limits or edges of a unit set or form 10 in a continuous web of such unit sets. The top ply 12, the carbon sheet 18 and the liner 44 may be attached by means of crimps 49. A preferred size of a unit set is 6" by 10.25" which dimensions include the margin strips 22 and 26, as in the top ply 12. It is seen from FIGS. 1 and 2 that the middle ply 14 and the bottom ply 16 are of different sizes to provide the desired design and construction of the form 10. Of course, the size of a form or unit set may be any one of the common press sizes of 14", 16", 17", 18", 19", 20", 21", 22", 24", 25 ½", 28" or any divisors thereof.

Figure 3:
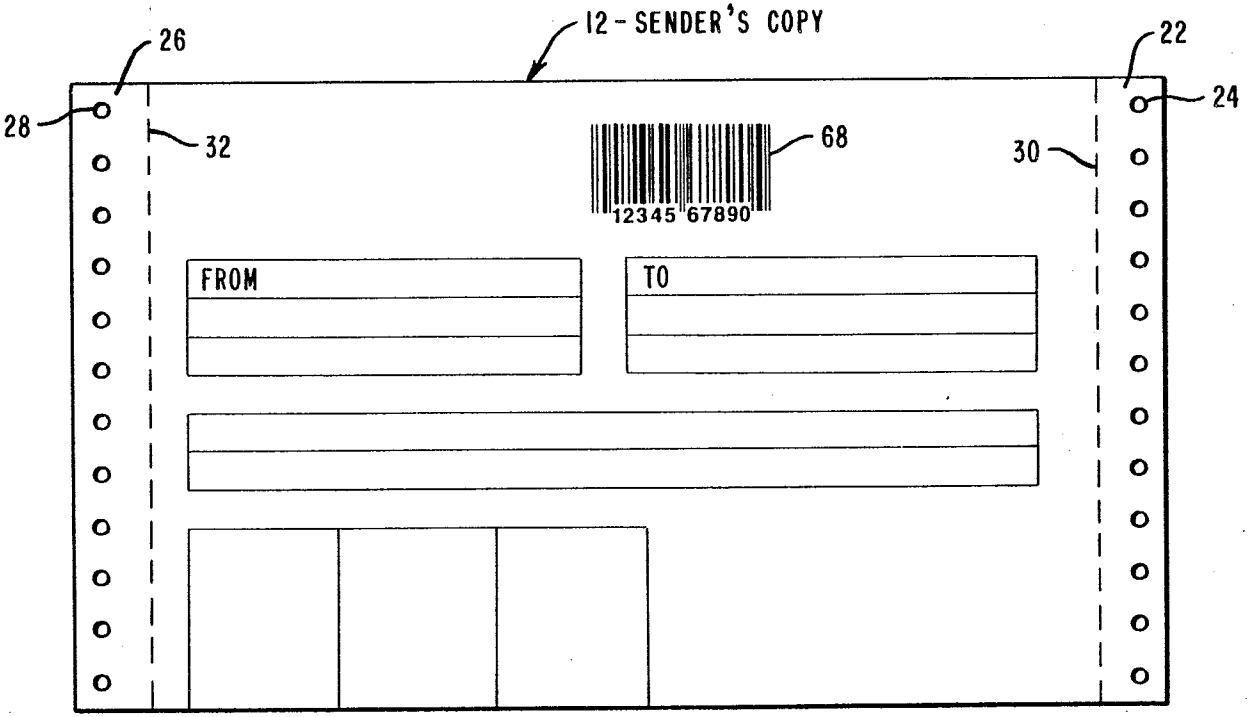
FIG. 3 is a plan view of the top ply.

FIG. 3 is a plan view of the top ply 12 which is the sender's copy and includes a bar code 68 in the upper portion of the form. Of course, the bar code may be located in any convenient place on the form 10. The right margin strip 22 with holes 24 and the left margin strip 26 with holes 28 are connected to the top ply 12 by the respective perf lines 30 and 32. The top ply 12 also includes the necessary and well-known printed matter and spaces for names and addresses of the parties to the shipping transaction along with associated blocks which are checked or filled in according to the desired services.

Figure 4:
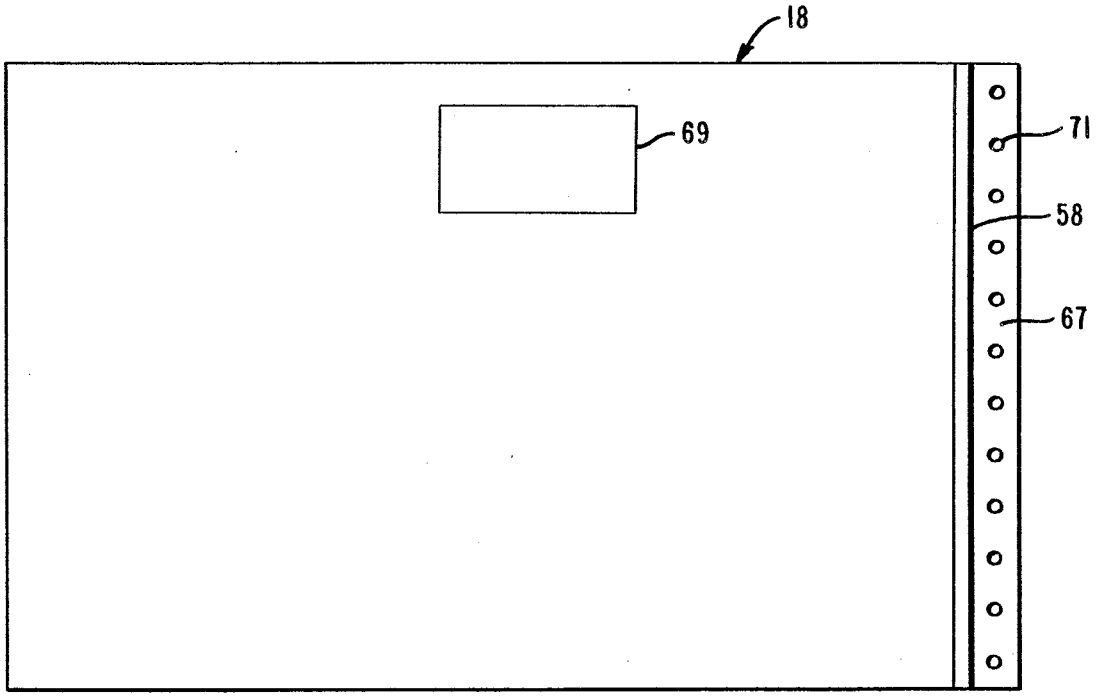
FIG. 4 is a plan view of a first carbon sheet.

FIG. 4 is a plan view of the carbon sheet 18 with pin feed holes 71 along the right side thereof matching the pin feed holes 24 in ply 12. The glue line 58 is shown on the sheet 18 inside the pin feed holes 71. It is to be noted that the carbon sheet 18 has a clear area portion 67 along the right hand edge thereof under the margin strip 22 of the top ply 12 and also has a clear area portion 69 under the area occupied by the bar code 68 of the top ply 12.

Figure 5:
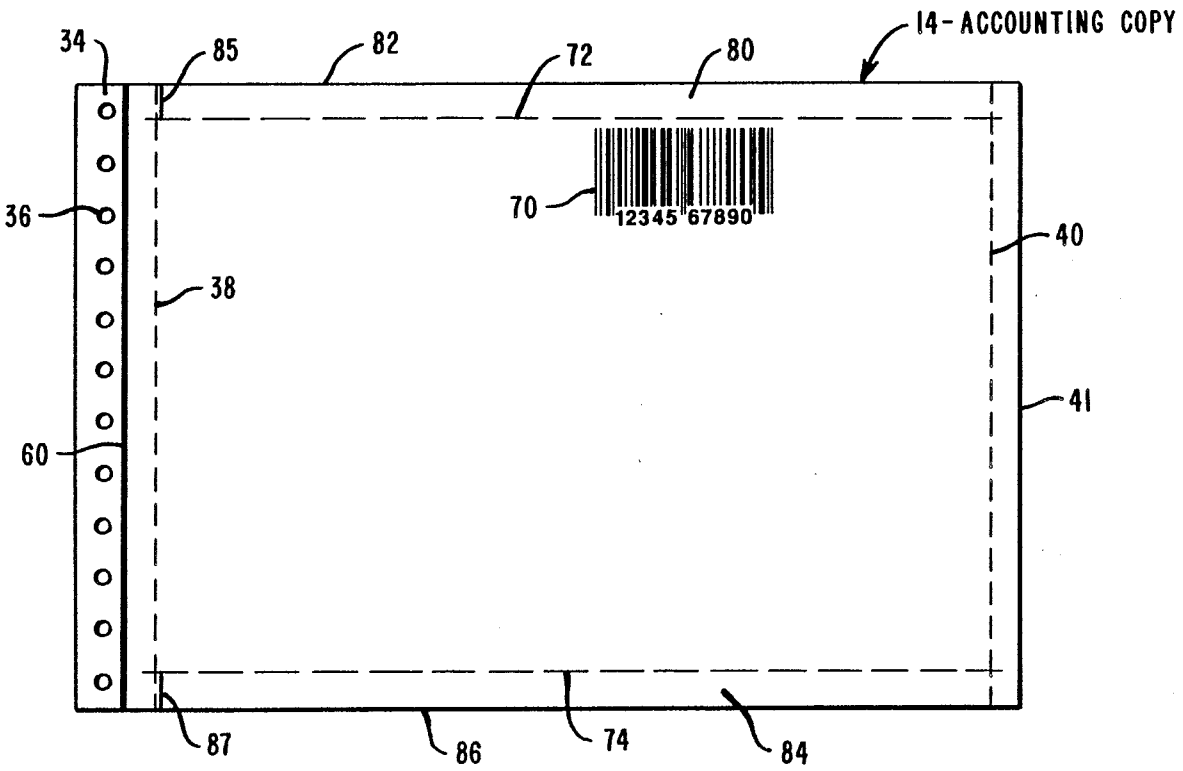
FIG. 5 is a plan view of the intermediate ply.

FIG. 5 is a plan view of the middle ply 14 which is the accounting copy and includes a bar code 70 in the upper portion. The perf line 40 is shown at the right hand edge. The left margin strip 34 with holes 36 is connected to the middle ply 14 by the perf line 38. The glue line 60 is shown in the margin strip 34 between the perf line 38 and the feed holes 36. The middle ply 14 has a cross perf line 72 along the upper edge 32 thereof for providing an edge portion 80 and a cross perf line 74 along the lower edge 86 thereof for providing an edge portion 84. Lance cuts 85 and 87 are provided in ply 14 at the left side thereof. The middle ply 14 also includes the necessary and well-known printed matter and spaces as mentioned above and as shown in FIG. 3.

Figure 6:
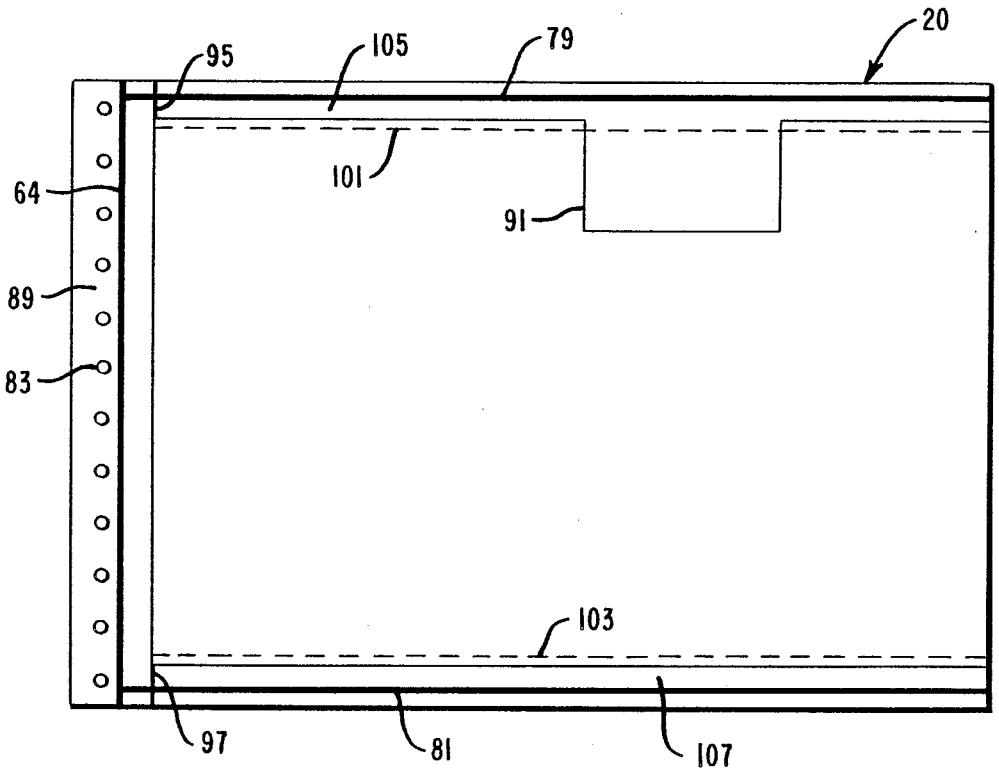
FIG. 6 is a plan view of a second carbon sheet.

FIG. 6 is a plan view of the carbon sheet 20 with pin feed holes 83 along the left side thereof matching the pin feed holes 36 in ply 14 and the pin feed holes 28 in ply 12. The glue line 64 is shown on the sheet 20 inside the holes 83. It is to be noted that the carbon sheet 20 has a clear area portion 89 along the left hand edge thereof under the margin strip 34 of the middle ply 14 and also has a clear area portion 91 under the area occupied by the bar code 70 of the middle ply 14. A cross perf line 101 is provided at the upper edge of the carbon sheet 20 and adjacent a clear area portion 105 of the sheet 20. A cross perf line 103 is provided at the lower edge of the carbon sheet 20 and adjacent a clear area portion 107 of the sheet 20. Lance cuts 95 and 97 are provided in the carbon sheet 20 at the left side thereof.

Figure 7:
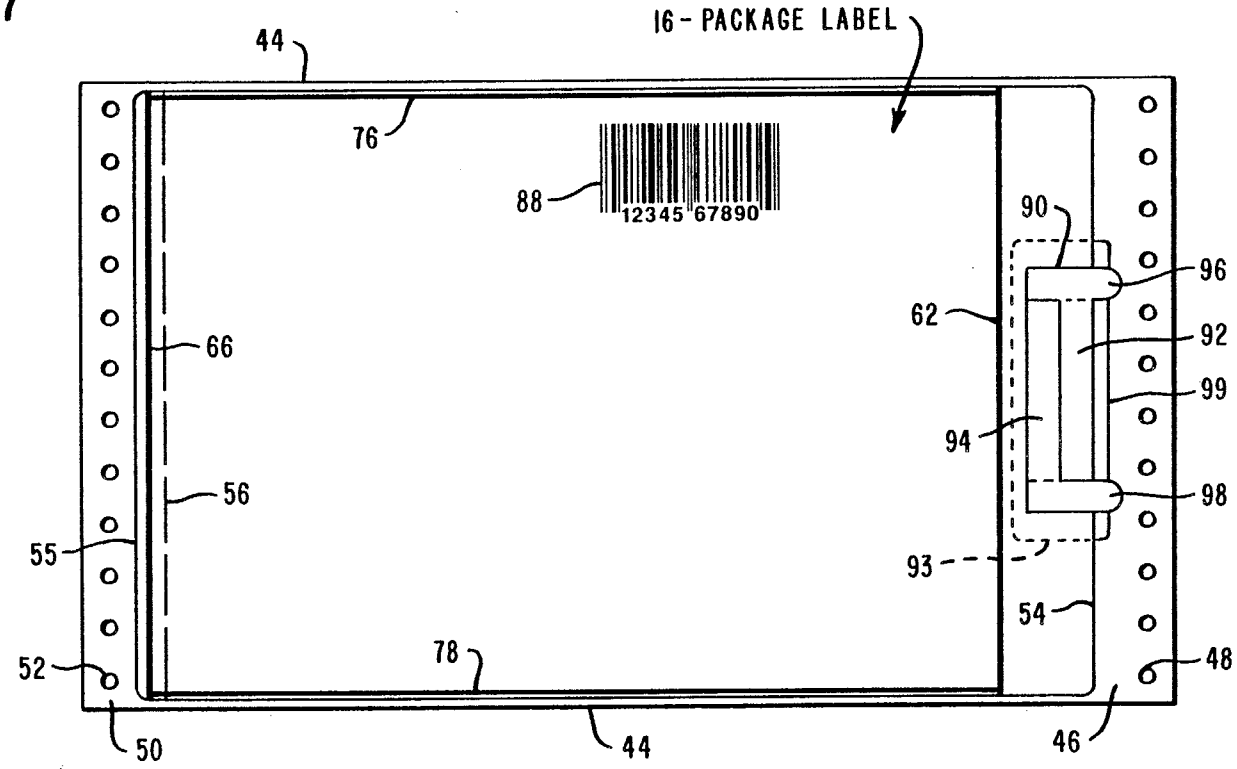
FIG. 7 is a plan view of the bottom ply.

FIG. 7 is a plan view of the label ply 16 which is the package label and includes a bar code 88 in the upper portion of the form 10. The release liner 44 is also shown and includes the right hand portion 46 with holes 48 and the holes 52 in the left hand portion 50 of the liner. FIG. 7 also shows a tracking label 90 at the right hand edge of the label ply 16. The tracking label 90 is pressure-sensitive glued to the release liner 44 and includes two portions 92 and 94 each with the same tracking number thereon. A tab 96 is attached to portion 92 and a tab 98 is attached to portion 94 for easy removal of the portions from the release liner ply 44. The tracking label 90 is provided by means of a back die cut 99. The liner under the package tracking numbers allows for separate tracking labels even though the face stock of the tracking labels is the same as the face stock of the label ply 16. The tabs on the package tracking number labels provide for easy removal of such labels.

It is thus seen that the top ply 12 is connected to the left margin strip 26 by the perf line 32, and that the carbon 18 is secured to the top ply 12 in the right margin strip 22 by the glue line 58. The top ply 12 is secured to the middle ply 14 in the left margin strips 26 and 34 by the glue line 60, and the carbon 20 is secured to the middle ply 14 in the left margin 34 by the glue line 64.

Three edges (top, bottom and left side as seen in FIG. 1) of the middle ply 14 are attached by glue lines 79, 64 and 81 to the top surface of the carbon 20. The right hand edge of the middle ply 14 is secured to the bottom ply 16 by the glue line 62. Three edges (top, bottom and left side as seen in FIG. 1) of the bottom ply 16 are glued to the clear areas of the bottom surface of the carbon sheet 20 by glue lines 66, 76 and 78. The perf line 40 in the middle ply 14, which is located inside the glue line 62, enables easy removal of the middle ply 14 and the carbon ply 20.

In the use of the business form of the present invention, the information or data is typed or written in the appropriate places on the top ply 12, such information or data being transferred to plies 14 and 16 by the carbon sheets 18 and 20 or in carbonless form by capsule damage and chemistry migration ply to ply. The sender of the package removes the top ply 12 and the carbon sheet 18 and retains such ply 12 as a trailing audit receipt of the shipping transaction. The middle ply 14 is secured on three edges to the carbon sheet 20 by glue lines 64, 79 and 81 and the remaining edge is secured to the label ply 16 by glue line 62 so as to stay intact during handling of the package by the sender and the courier. The release liner 44 is then removed by the sender and the label ply 16 with the attached middle ply 14 and carbon sheet 20 are applied and secured to the package. The ply 14, the sheet 20 and the ply 16 of the form 10 are securely attached to the package across the entire back surface of the label ply 16 by means of the adhesive coating 42 except for the liner portion 93 under the package tracking numbers. The courier or transporter of the package then removes the middle ply 14 for record or accounting purposes and sends the package on its way. The middle ply 14 and carbon sheet 20 are removed from the form 10 by lifting the left margin strip 34, and pulling the middle ply 14 and the attached carbon sheet 20 to the right. The middle ply 14 and the carbon sheet 20 removal is facilitated by the lance cuts 85 and 87 (FIG. 5) and lance cuts 95 and 97 (FIG. 6) and is separated from the edges thereof along the upper and lower cross lines of perforation 72 and 74 of ply 14 and along the upper and lower cross lines of perforation 101 and 103 of sheet 20. The middle ply 14 and the carbon sheet 20 are then detached from the right hand edge of the label ply 16 by separating at the perf line 40. The middle ply 14 is then separated from strip 34 at the perf line 38. This provides a clean copy of ply 14 and the carbon sheet 20 is discarded. While it is noted that the middle ply 14 is secured to the carbon sheet 20 along the three edges, there is no residue, glue or otherwise, on the back of the ply 14 when such ply is removed from the form 10.

Figure 9:
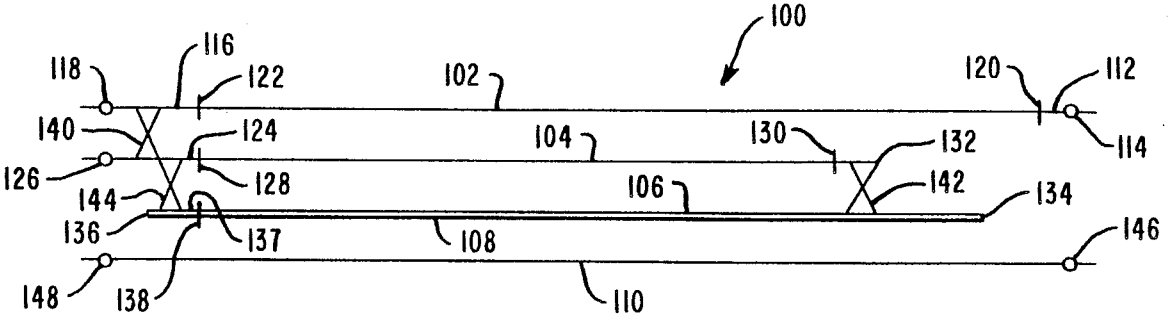
FIG. 9, on the sheet with FIG. 2, is an end view showing the construction of the modified form.
Figure 8:
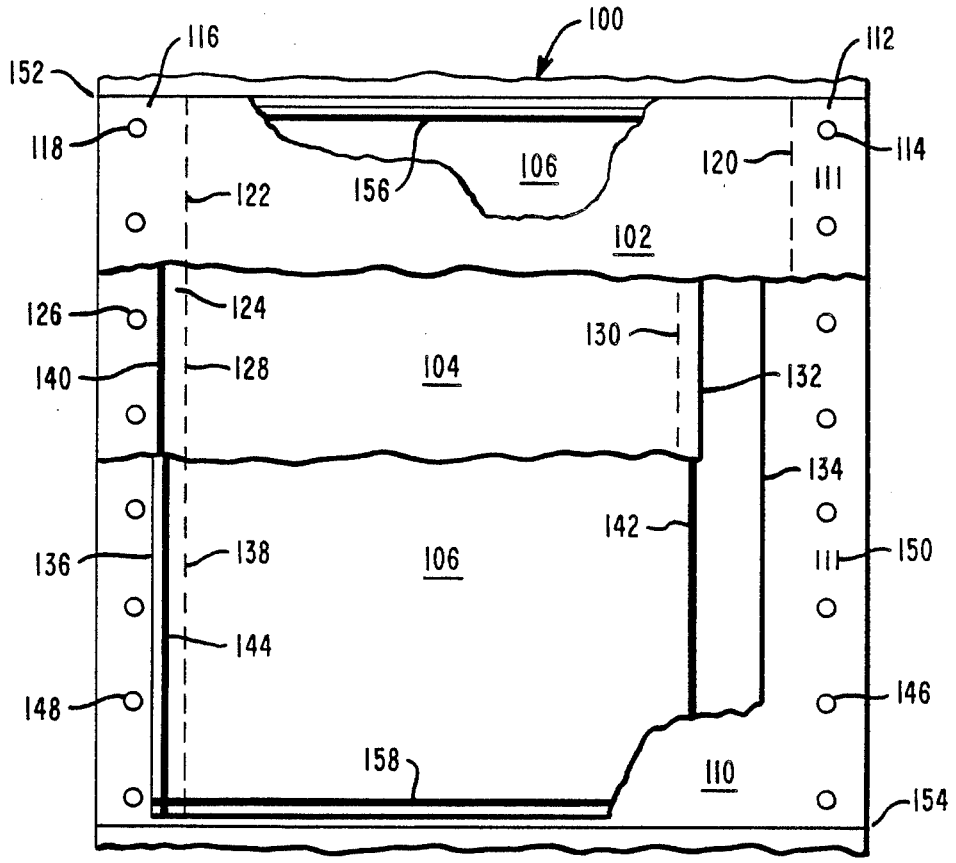
FIG. 8 is a top or front plan view of a modified arrangement of a business form using carbonless sheets.

FIGS. 8 and 9 illustrate a modified arrangement of a business form 100 which includes a top ply 102, a middle ply 104, a bottom ply 106 with a coating 108 of adhesive on the bottom surface thereof, and a release liner ply 110 covering the adhesive coating. As alluded to above, the top ply 102 is CB paper, the middle ply 104 is CFB paper, and the bottom ply 106 is CF paper.

A margin strip 112 with pin feed holes 114 is provided at the right side of the form 100 in the top ply 102 and a margin strip 116 with pin feed holes 118 is provided at the left side of the form 100 in the top ply 102. The margin strip 112 is connected to the top ply 102 by a perf line 120 and the margin strip 116 is connected to the top ply 102 by a perf line 122.

A margin strip 124 with pin feed holes 126 is provided at the left side of the form 100 in the middle ply 104 and the strip 124 is connected to the middle ply 104 by a perf line 128. The right side of the middle ply 104 does not have a margin strip but does include a perf line 130 spaced from the right edge 132.

A right edge 134 of the bottom ply 106 is spaced inward of the pin feed holes 114 in the margin strip 112 of the top ply 102. A left edge 136 of the bottom ply 106 is spaced inward of the pin feed holes 118 in the margin strip 116 of the top ply 102 and also is spaced inward of the pin feed holes 126 in the margin strip 124 of the middle ply 104. The bottom ply 106 has a weak perf line 138 at the left side thereof aligned with the perf line 122 in the top ply 102 and with the perf line 128 in the middle ply 104.

A line of adhesive 140 within the margin strip 124 and between the pin feed holes 126 and the perf line 128 secures the top ply 102 and the middle ply 104 at the left sides thereof. A glue line 142 spaced inward of the right edge 134 of the bottom ply 106 and adjacent the perf line 130 of the middle ply 104 secures the middle ply 104 and the bottom ply 106 at the right sides thereof. A glue line 144 adjacent the perf line 128 in the middle ply 104 and adjacent the perf line 138 in the bottom ply 106 secures the middle ply 104 and the bottom ply 106 at the left sides thereof. The glue line 144 is nonaligned with the glue line 140. The weak perf line 138 provides a strip portion 137 at the left edge of the bottom ply 106 which remains with the middle ply 104 after removal of the release liner ply 110 from the ply 106.

The release liner ply 110 has pin feed holes 146 at the right side thereof and has pin feed holes 148 at the left side. The top ply 102 and the release liner ply may be attached by means of crimps 150 in the margin strip 112 of the top ply 102.

Fold lines 152 and 154 designate the limits or edges of a unit set or form 100 in a continuous web of such unit sets. A cross glue line 156 is provided on the face or top surface of the bottom ply 106 adjacent the fold line 152 for securing the bottom ply 106 and the middle ply 104 at the upper edge of the form 100. A like cross glue line 158 is provided on the face or top surface of the bottom ply 106 adjacent the fold line 154 for securing the bottom ply 106 and the middle ply 104 at the lower edge of the form 100.

It is thus seen that herein shown and described is a business form that is supplied as a unit set and includes a top ply, a first carbon sheet, an intermediate ply, a second carbon sheet, and a bottom ply having record information or data on each ply and the bottom ply is secured as a record copy to a package being shipped. The business form may include a combination of carbon and carbonless sheets. Other features of the construction of the business form include the provision of a transparent clear overcoat over the bar code and the use of various forms of printing on the face of the business form which printing is well-known in the art.

The construction of the business form of the present invention enables the accomplishment of the objects and advantages mentioned above, and while a preferred embodiment and a modification have been disclosed herein, other variations thereof may occur to those skilled in the art. It is contemplated that all such variations not departing from the spirit and scope of the invention hereof are to be construed in accordance with the following claims.

What is claimed is:

1. A business form for use in shipping parcels comprising a first ply having printed indicia thereon and including spaces for entering information concerning the names and addresses of the parties involved in a parcel shipping transaction, said first ply including a first line of weakening spaced from one edge of the first ply and a second line of weakening spaced from the opposite edge of the first ply enabling removal of the first ply from the business form, a second ply having printed indicia and spaces thereon substantially the same as on said first ply, said second ply having a first line of weakening spaced from one edge of the second ply and a second line of weakening spaced from the opposite edge of the second ply enabling removal of the second ply from the business form, said second ply being secured to said first ply adjacent said second lines of weakening spaced from said opposite edges of said first and said second plies, a first carbon sheet between said first and said second plies, a third ply having printed indicia and spaces thereon substantially the same as on said first and said second plies, said second ply being secured to said third ply by first continuous means positioned adjacent the first line of weakening spaced from said one edge of said second ply and adjacent one edge of said third ply, said second ply being secured to said third ply by second continuous means positioned adjacent said second line of weakening of said second ply, and said second ply being secured to said third ply by spaced continuous means across said second ply normal to said first and said second continuous means, said third ply having a coating of adhesive on one surface thereof, a second carbon sheet between said second and said third plies, said third ply being secured to said second carbon sheet adjacent the opposite edge of said third ply, and a release ply covering the adhesive coating on said one surface and removable therefrom to enable applying of the third ply on a parcel being shipped, said third ply having a removable strip portion adjacent said opposite edge thereof, said removable strip portion remaining with said second carbon sheet after removal of said release ply from said third ply.

2. The business form of claim 1 wherein said first carbon sheet is secured to said first ply adjacent said first line of weakening spaced from said one edge of said first ply, and said second carbon sheet is secured to said second ply adjacent said second line of weakening spaced from said opposite edge of said second ply.

3. The business form of claim 1 wherein said second ply includes spaced cross lines of weakening perpendicular to said first and said second lines of weakening, the removal of said second ply leaving edge portions of said second ply remaining with said third ply and attached thereto.

4. The business form of claim 1 wherein said second ply is secured by means of lines of adhesive to said third ply along all four edges thereof, the edge portions of said second ply providing a securing of said second ply to said third ply.

5. The business form of claim 1 wherein said third ply includes a line of weakening aligned with said second lines of weakening spaced from said opposite edges of said first and said second plies and said second carbon sheet is secured to said third ply adjacent said line of weakening in said third ply.

6. The business form of claim 5 wherein said second carbon sheet is secured to said second ply adjacent said second line of weakening spaced from said opposite edge of said second ply and is secured to said third ply adjacent said line of weakening therein.

7. The business form of claim 1 wherein said second ply is secured to said first ply by a line of adhesive adjacent said lines of weakening spaced from said opposite edges of said first and said second plies, said second ply is secured to said third ply by a line of adhesive adjacent said line of weakening spaced from said one edge of said second ply, and said second ply is secured to said second carbon sheet by a line of adhesive adjacent said line of weakening spaced from said opposite edge of said second ply and said second carbon sheet is secured to said third ply by a line of adhesive adjacent the line of weakening spaced from one edge of said third ply, the latter line of adhesive being nonaligned with the line of adhesive securing the second ply and the second carbon sheet.

8. A business form for use in shipping parcels comprising a first ply having printed indicia thereon and including spaces for entering information concerning the names and addresses of the parties involved in a parcel shipping transaction, said first ply including a first line of weakening spaced from one edge of said first ply and a second line of weakening spaced from the opposite edge of said first ply enabling removal of the first ply from the business form, said first ply having a carbonless coating on the back surface thereof for transferring said information, a second ply having printed indicia and spaces thereon substantially the same as on said first ply, said second ply having a first line of weakening spaced from one edge of the second ply and a second line of weakening spaced from the opposite edge of the second ply enabling removal of the second ply from the business form, said second ply being secured to said first ply adjacent said second lines of weakening spaced from said opposite edges of said first and said second plies, said second ply having a carbonless coating on the front surface thereof for receiving said information transferred from said first ply and having a carbonless coating on the back surface thereof for transferring said information, a third ply having printed indicia and spaces thereon substantially the same as on said first and said second plies, said second ply being secured to said third ply by first continuous securing means positioned adjacent said first line of weakening spaced from said one edge of said second ply and adjacent one edge of said third ply, said second ply being secured to said third ply by second continuous securing means positioned adjacent the second line of weakening spaced from said opposite edge of said second ply, and said second ply being secured to said third ply by spaced continuous securing means across said second ply normal to said first and said second continuous securing means, said third ply having a carbonless coating on the front surface thereof for receiving said information transferred from said second ply and having a coating of adhesive on the back surface thereof, and a release ply covering the adhesive coating on said back surface and removable therefrom to enable applying of the third ply on a parcel being shipped, said third ply having a removable strip portion adjacent said opposite edge thereof, said removable strip portion remaining with said second ply after removal of said release ply from said third ply.

9. The business form of claim 8 wherein said second ply includes spaced cross lines of weakening perpendicular to said first and said second lines of weakening, the removal of said second ply leaving edge portions of said second ply remaining with said third ply and attached thereto.

10. The business form of claim 8 wherein said second ply is secured by means of labels of adhesive to said third ply along all four edges thereof.

11. The business form of claim 8 including a die cut portion formed in said third ply and having a pair of tracking labels formed in said die cut portion of said third ply at one edge thereof.

12. The business form of claim 11 wherein said pair of tracking labels each include a tab portion extending beyond the edge of said third ply.

13. A business form for use in shipping parcels, said business form being one of a plurality of continuous form type separated by transverse fold lines, said business form comprising a first ply having printed indicia thereon and including spaces for entering information concerning the names and addresses of the parties involved in a parcel shipping transaction, said first ply including a first line of weakening spaced from one edge of said first ply and a second line of weakening spaced from the opposite edge of said first ply enabling removal of the first ply from the business form, said first ply having a carbonless coating on the back surface thereof for transferring said information, a second ply having printed indicia and spaces thereon substantially the same as on said first ply, said second ply having a first line of weakening spaced from one edge of the second ply and a second line of weakening spaced from the opposite edge of the second ply enabling removal of the second ply from the business form, said second ply being secured to said first ply adjacent said second lines of weakening spaced from said opposite edges of said first and said second plies, said second ply having a carbonless coating on the front surface thereof for receiving said information transferred from said first ply and having a carbonless coating on the back surface thereof for transferring said information, a third ply having printed indicia and spaces thereon substantially the same as on said first and said second plies, said second ply being secured to said third ply by first continuous securing means positioned adjacent said first line of weakening spaced from said one edge of said second ply and adjacent one edge of said third ply, said second ply being secured to said third ply by second continuous securing means positioned adjacent the second line of weakening spaced from said opposite edge of said second ply, and said second ply being secured to said third ply by spaced continuous securing means adjacent said fold lines and normal to and joining said first and said second continuous securing means, said third ply having a carbonless coating on the front surface thereof for receiving said information transferred from said second ply and having a coating of adhesive on the back surface thereof, and a release ply covering the adhesive coating on said back surface and removable therefrom to enable applying of the third ply on a parcel being shipped.

14. The business form of claim 13 wherein said second ply includes spaced cross lines of weakening perpendicular to said first and said second lines of weakening, the removal of said second ply leaving edge portions of said second ply remaining with said third ply and attached thereto.

15. The business form of claim 13 wherein said second ply is secured by means of lines of adhesive to said third ply along all four edges thereof.

16. The business form of claim 13 wherein said spaced continuous securing means comprises lines of adhesive adjacent said fold lines.

* * * * *